United States Patent [19]

Winship

[11] 4,426,939

[45] Jan. 24, 1984

[54] METHOD OF REDUCING $NO_x$ AND $SO_x$ EMISSION

[75] Inventor: Ralph D. Winship, Ottawa, Canada

[73] Assignee: Combustion Engineering, Inc., Windsor, Conn.

[21] Appl. No.: 476,947

[22] Filed: Mar. 21, 1983

[30] Foreign Application Priority Data

Jun. 8, 1982 [CA] Canada ..... 408899

[51] Int. Cl.[3] ..... F23K 1/00; F23D 1/00

[52] U.S. Cl. ..... 110/347; 110/261; 110/263

[58] Field of Search ..... 110/347, 106, 261, 263, 110/264, 265

[56] References Cited

U.S. PATENT DOCUMENTS

| | | | |
|---|---|---|---|
| 4,150,631 | 4/1979 | Frey et al. | 110/265 |
| 4,173,189 | 11/1979 | Cooper | 110/106 |
| 4,184,456 | 1/1980 | Taylor et al. | 110/101 R |
| 4,246,853 | 1/1981 | Mehta | 110/347 |
| 4,249,470 | 2/1981 | Vatsky | 110/264 |
| 4,252,069 | 2/1981 | McCartney | 110/265 |
| 4,274,343 | 6/1981 | Kokkinos | 110/347 |
| 4,294,178 | 10/1981 | Borio et al. | 110/347 |
| 4,304,196 | 12/1981 | Chadshay et al. | 110/347 |
| 4,316,420 | 2/1982 | Kochey | 110/347 |

*Primary Examiner*—Henry C. Yuen

*Attorney, Agent, or Firm*—Robert L. Olson

[57] ABSTRACT

The method of operating a furnace including the steps of conveying (30) pulverized coal in an air stream towards a furnace (10), separating (34) the stream into two portions (36,38), one being a fuel rich portion (38), and the other being a fuel lean portion (36), introducing (40) the fuel rich portion into the furnace in a first zone, introducing (42,44) air into the first zone in a quantity insufficient to support complete combustion of all of the fuel in the fuel rich portion, introducing (46) the fuel lean portion into the furnace in a second zone, introducing (48) air into the second zone in a quantity such that there is excess air over that required for combustion of all of the fuel within the furnace, and introducing (50) lime into the furnace simultaneously with the fuel, so as to minimize the peak temperature within the furnace, and also minimize the formation of $NO_x$ and $SO_x$ in the combustion gases.

5 Claims, 3 Drawing Figures

METHOD OF REDUCING $NO_x$ AND $SO_x$ EMISSION

BACKGROUND OF THE INVENTION

With present day concern about air pollution, efforts are being made to burn coal or other solid fuel with a minimum of $NO_x$ and $SO_x$ in the combustion exhaust gases. In firing pulverized coal in the furnace of a steam generator, it is known that reducing the peak flame temperature will reduce the $NO_x$ formed. It is also known that firing with a deficiency of air (sub-stoichiometric or fuel rich) or with very little excess air (0–3%) will reduce flame temperature, thus minimizing the emission of $SO_x$ from the sulphur contained in the coal. The lower temperature encourages alkali material (in the coal itself or injected with the coal) to react with the sulphur. Also, with lower temperature, more reactive sulphur compounds are formed.

SUMMARY OF THE INVENTION

In accordance with the invention, a furnace is fired with pulverized coal in a manner that reduces the peak temperature in the furnace while still maintaining good flame stability and complete combustion of the fuel. This is accomplished by separating the airborne fuel flowing to the furnace into two streams, one being fuel rich, and the other being fuel lean.

DESCRIPTION OF THE PREFERRED EMBODIMENT

Figure 1:
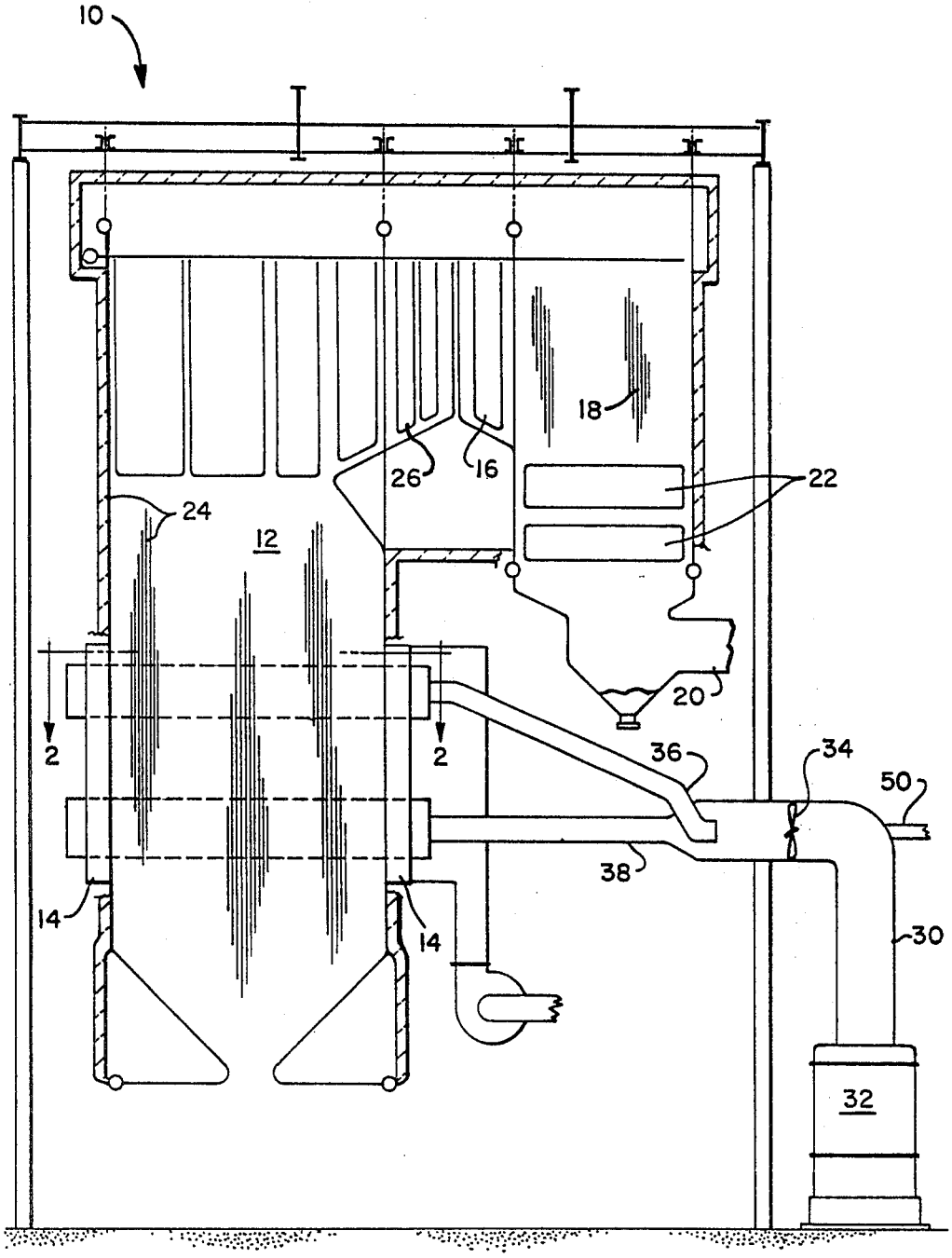
FIG. 1 is a diagrammatic representation of a coal-fired furnace in the nature of a vertical sectional view incorporating the present invention.
Figure 2:
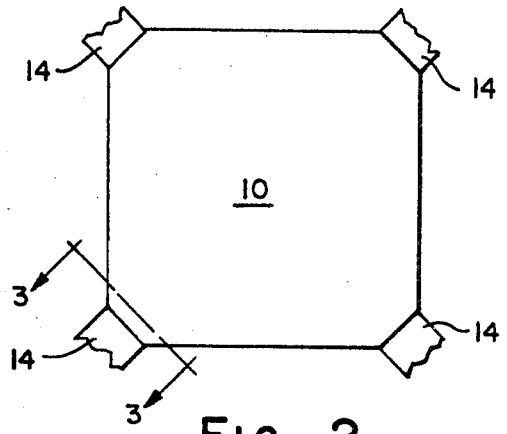
FIG. 2 is an enlarged sectional view taken on line 2—2 of FIG. 1.

Looking now to FIG. 1 of the drawings, numeral 10 designates a steam generating unit having a furnace 12. Fuel is introduced into the furnace and burns therein by tangential burners 14. The hot combustion gases rise and exit from the furnace through horizontal pass 16 and rear pass 18 before being exhausted to the atmosphere through duct 20 which is connected to a stack, not shown. Steam is generated and superheated by flowing through the various heat exchangers located in the unit. Water is heated in economizer 22 and then flows through the water tubes 24 lining the furnace walls, where steam is generated. From there the steam passes through the superheater 26, and thereafter flows to a turbine, not shown.

The burner system will now be described in greater detail. Pulverized coal is carried in a stream of air in duct 30 leaving bowl mill 32. A spinning vane 34 imparts centrifugal force to the mixture passing therethrough, causing a majority of the heavier particles to move outwardly towards the wall of the duct. A duct 36 is located with its inlet positioned so that the fuel lean central stream enters therein. The fuel rich portion continues to flow through duct 38 to the burners 14.

Figure 3:
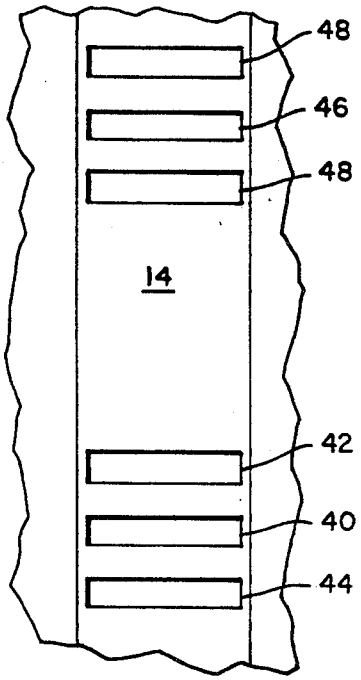
FIG. 3 is an enlarged partial view taken on line 3—3 of FIG. 2.

As best seen in FIG. 3, the fuel rich stream is introduced into the furnace through burner nozzle 40, with secondary air being introduced both above and below it through openings 42 and 44. The fuel lean stream is introduced to the furnace through burner nozzle 46, which is spaced from the fuel rich nozzle 40, and located in a zone higher up in the furnace. More secondary air is introduced through openings 48. If additional alkali is desired to be added, lime can be added to the fuel-air stream through pipe 50 (FIG. 1). Although the additional lime is shown as being added to the fuel stream, it could also be introduced separately to the furnace in the zone where the fuel rich stream is being combusted. The higher the sulphur content of the fuel, the greater the amount of lime that should be added.

As mentioned earlier, the dense or fuel rich stream entering the furnace through nozzle 40 is fairly easy to ignite and easy to maintain a stable flame. Thus the warm up guns or ignition means for the furnace are directed at this stream. The secondary air needed to maintain a stable flame with this stream is minimal, so the flame at the burner level can be sub-stoichiometric; i.e. less air than that required for complete combustion of the fuel in this zone. The majority of the secondary air can thus be introduced through openings 48, so that some of the fuel from the fuel rich stream, and the majority of the fuel from the fuel lean stream, will be combusted higher up in the furnace. The fuel lean stream is also introduced higher up in the furnace. Thus the peak temperature within the furnace, which is at the primary burner level, is maintained relatively low. This minimizes the formation of $NO_x$, and also acts to maintain optimum conditions for the combination of the sulphur with the lime, thus also preventing the emission of $SO_x$ from the furnace. Although the invention has been illustrated in conjunction with a tangentially fired furnace, it has wider application, and can be used with other firing systems. The only requirements are that the fuel-air stream flowing to a furnace be separated (by any suitable means) into a fuel rich portion and a fuel lean portion. The fuel rich portion is then fired sub-stoichiometrically (less air than that required for complete combustion) to keep the peak furance temperature low. With this type of firing, formation of $NO_x$ and $SO_x$ will be minimized.

I claim:

1. The method of operating a furnace including the steps of conveying pulverized coal in an airstream towards a furnace, separating the stream into two portions, one being a fuel rich portion, and the other being a fuel lean portion, introducing the fuel rich portion into the furnace in a first zone, introducing air into the first zone in a quantity insufficient to support complete combustion of all of the fuel in the fuel rich portion, introducing the fuel lean portion into the furnace in a second zone located at a higher elevation than the first zone, introducing air into the second zone in a quantity sufficient to support complete combustion of all of the fuel in both the fuel rich and fuel lean portions, so as to minimize the peak temperature within the furnace, and also minimize the formation of $NO_x$ and $SO_x$ in the combustion gases.

2. The method set forth in claim 1, including the step of introducing lime into the furnace simultaneously with the fuel.

3. The method set forth in claim 2, wherein the quantity of air introduced into the second zone is such that there is excess air over that required for combusting all of the fuel within the furnace.

4. The method set forth in claim 3, wherein the coal is introduced into the first zone of the furnace from the four corners thereof in such a manner that it is directed tangentially to an imaginary circle located in the center of the furnace.

5. The method set forth in claim 4, wherein the coal is introduced into the secone zone of the furnace from the four corners thereof in such a manner that it is directed tangentially to an imaginary circle located in the center of the furnace.

* * * * *